US009486388B2

(12) United States Patent
Wright, Jr.

(10) Patent No.: US 9,486,388 B2
(45) Date of Patent: Nov. 8, 2016

(54) STIMULATOR APPARATUS

(71) Applicant: Eric Vincent Wright, Jr., Philadelphia, PA (US)

(72) Inventor: Eric Vincent Wright, Jr., Philadelphia, PA (US)

( * ) Notice: Subject to any disclaimer, the term of this patent is extended or adjusted under 35 U.S.C. 154(b) by 107 days.

(21) Appl. No.: 13/892,286

(22) Filed: Jul. 29, 2013

(65) Prior Publication Data

US 2015/0031945 A1 Jan. 29, 2015

(51) Int. Cl.

| | |
|---|---|
| ***A61H 19/00*** | (2006.01) |
| *A61H 9/00* | (2006.01) |
| *A61H 23/02* | (2006.01) |

(52) U.S. Cl.

CPC ..... *A61H 19/32* (2013.01); *A61H 9/0057* (2013.01); *A61H 23/02* (2013.01); *A61H 2201/0153* (2013.01); *A61H 2201/0207* (2013.01); *A61H 2201/105* (2013.01); *A61H 2201/1695* (2013.01)

(58) Field of Classification Search

CPC ..... A61B 10/0058; A61B 10/00; A61F 2201/5082; A61F 2201/105; A61H 19/00; A61H 19/32

USPC ..... 600/38–41

See application file for complete search history.

(56) References Cited

U.S. PATENT DOCUMENTS

| | | | | |
|---|---|---|---|---|
| 5,466,235 | A * | 11/1995 | Shubin, Sr. | 600/38 |
| 5,782,818 | A * | 7/1998 | Shubin | 604/349 |
| 8,475,422 | B2 * | 7/2013 | Wu | 604/349 |
| 2013/0053631 | A1 * | 2/2013 | Kolar | 600/38 |

* cited by examiner

*Primary Examiner* — Samuel Gilbert

(74) *Attorney, Agent, or Firm* — Ariel S. Bentolila; Bay Area IP Group, LLC

(57) ABSTRACT

A stimulator apparatus for stimulating an organ, such as a penis. The apparatus includes a spherical housing configured to receive an organ through at least one aperture and allow for a 180° range of motion while manipulating the organ and/or the stimulator apparatus. The stimulator apparatus provides intensified sexual stimulation through frictional engagement between the organ and at least one channel in the housing. The at least one aperture includes a cover, and is sized and dimensioned to resemble a female sexual organ. The at least one channel includes numerous textures, orientations, diameters, and mechanical features to help enhance sexual stimuli for the organ. At least one grip portion positions on the housing to allow for sufficient grip for a user to manipulate the stimulator apparatus to a desired intensity and duration. The at least one grip comprises multiple indentations that match each finger.

20 Claims, 6 Drawing Sheets

STIMULATOR APPARATUS

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to stimulators. More particularly, the invention relates to spherical sexual stimulators.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that masturbation is the sexual stimulation of one's own genitals, usually to the point of orgasm. The stimulation can be performed using the hands, fingers, everyday objects, or dedicated sex toys.

Typically, a sex toy is an object or device that is primarily used to facilitate human sexual pleasure, such as a dildo or vibrator. Many popular sex toys are designed to resemble human genitals and may be vibrating or non-vibrating.

Often, flesh like materials are utilized in sex toys. Silicone is soft and life-like, it is hypoallergenic, warms up quickly to body temperature, non-porous and so is easy to clean.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
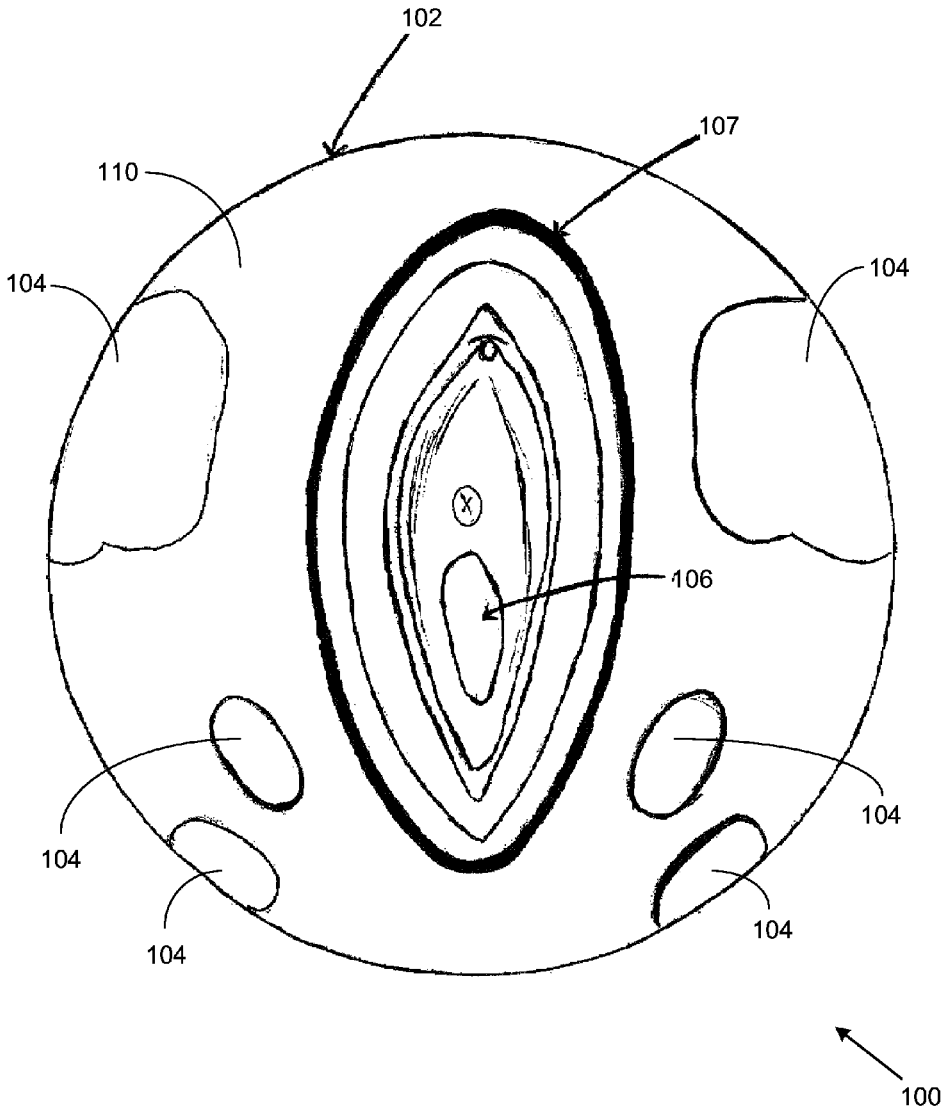
FIG. 1 illustrates a detailed perspective view of an exemplary stimulator apparatus, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of stimulators that may be provided by preferred embodiments of the present invention. In one embodiment of the present invention, a stimulator apparatus may include a spherical sexual stimulator configured to receive an organ through at least one aperture and allow for a 180° range of motion while manipulating an organ inside at least one channel and/or the stimulator apparatus. The stimulator apparatus may provide intensified sexual stimulation through frictional engagement between the organ and the at least one channel. The at least one channel may be modified to include a variety of textures, orientations, diameters, and mechanical features to help enhance sexual stimulation of the organ. At least one grip portion on the housing may provide sufficient grip for a user to manipulate the stimulator apparatus, such that the organ achieves a desired intensity and duration of stimulation.

In one embodiment of the present invention, the stimulator apparatus may include housing for gripping and controlling the stimulator apparatus. The housing may include a substantially spherical shape, configured to be operable to be held by a hand. However, in other embodiments, the stimulator apparatus may include other shapes, including, without limitation, an orb, an oval, a ball, a globe, an ovoid, an ellipse, a curvilinear triangle, a polygon, a circle and a semicircle. It is to be understood that as a polygon gains more sides it resembles a sphere such as a pentagon, a hexagon, a heptagon, an octagon, a nonagon, a decagon, a dodecagon etc. As a polygon gains more vertices, the point where two segments meet, the outcome is a spherical shape. The housing may include at least one grip portion configured to be operable to be gripped by at least one finger. In this manner, a user may tightly control the orientation and directional movements of the sexual apparatus. The at least one grip allows for a 180° range of motion while manipulating the organ and/or the stimulator apparatus. Those skilled in the art, in light of the present teachings, will recognize that the range in motion may allow for a change in stimulus creating an intensified stimuli during inserting the organ into the at least one channel and manipulating the sexual apparatus. The housing may further include a substance for enhancing the sexual stimuli to the organ. The substance may include, without limitation, elastomer gel and medical grade silicone. The housing may include, without limitation, a rigid polymer casing for protecting internal components. The embodiment of one aperture connected to multiple channels allows the organ to be switched between different channels depending on the user's manipulation of the organ and/or stimulator apparatus. Channel selection is achieved through directional manipulation of the organ and stimulator apparatus. The channels may include, without limitation, soft substances like elastomer gel and medical grade silicone that allows the organ to slide into different channels easily. An aperture connected to one channel which is non intersecting and non connecting to other channels, the organ is stimulated by one channel unless switched to another aperture that is connected to a different channel.

In one embodiment of the present invention, the stimulator apparatus may include at least one aperture for at least partially receiving the organ. The organ may include, without limitation, a penis. The at least one aperture may be configured to resemble a mammalian orifice, including, without limitation, a female sexual organ, an anus, and a mouth. The at least one aperture may be disposed on the housing such that the at least one grip at least partially encircles the at least one aperture for enhanced control. In some embodiments, at least one channel may extend from the at least one aperture into an inner portion of the stimulator apparatus. The at least one channel may engage the organ to provide the sexual stimulation and/or massaging effect. The at least one channel may include various textures, directions, diameters, and mechanical features to further enhance the sexual stimuli. For example, without limitation, an organ may be gripped by the at least one grip portion, and inserted into a first aperture. The organ may stiffen in response to pressure from a first channel. The sexual stimulator may be oscillated in a masturbating motion to generate friction and a massaging effect on the organ. The organ may then be removed from the first aperture and inserted into a second aperture having a different texture and diameter. A vibration motion may be utilized to provide a different sensation.

FIG. 1 illustrates a detailed perspective view of an exemplary stimulator apparatus, in accordance with an embodiment of the present invention. In the present embodiment, a stimulator apparatus 100 may include a spherical sexual stimulator configured to receive an organ through at least one aperture and provide a 180° range of motion while manipulating the organ in at least one channel and/or the stimulator apparatus. The stimulator apparatus may provide intensified sexual stimulation through frictional engagement between the organ and the at least one channel. The at least one channel may be modified to include a variety of textures, orientations, diameters, and mechanical features to help enhance sexual stimulation of the organ. At least one grip portion on a housing 102 may provide sufficient grip for a user to manipulate the stimulator apparatus such that the organ achieves a desired intensity and duration of stimulation.

In one embodiment of the present invention, the stimulator apparatus may include a housing for gripping and controlling the stimulator apparatus. The housing may include a substantially spherical shape, configured to be operable to be held by a hand. However, in other embodiments, the stimulator apparatus may include other shapes, including, without limitation, an orb, an oval and a semicircle. The housing may include at least one grip portion 104 configured to be operable to be gripped by at least one finger. In this manner, a user may tightly control the orientation and directional movements of the sexual apparatus. The at least one grip allows for a 180° range of motion while manipulating the organ and/or the stimulator apparatus. The at least one grip may include, without limitation, a left palm indentation, a left pinky finger indentation, a left ring finger indentation, a right palm indentation, a right pinky finger indentation, and a right ring finger indentation. In this manner, the sexual stimulator may be gripped by either hand or both hands simultaneously during manipulation.

In one embodiment of the present invention, the housing may further include a substance in the interior for enhancing the sexual stimuli. The substance may be a part of the construction of the at least one channel. Substances include without limitation, silicone, gel, elastomer gel, jelly which is a PVC and rubber mixture, thermal plastic rubber (TPR) polymer blend, thermal plastic elastomer, Rubber, water and saline. The substance may enhance the stimulating effect on the organ. The substance may include, without limitation, elastomer gel and medical grade silicone. The housing may include, without limitation, a rigid casing 110 for protecting internal components. Suitable materials for fabricating the casing may include, without limitation, high density polymer, an acrylic, a lucite, polyvinyl chloride, a metal, a fiberglass, borosilicate glass, a rubber, a rubber mixture and wood. In some embodiments, the sexual stimulator may include a spherical shape with a 7" diameter, a 21.99" circumference, and weigh between 8 oz to 2 lbs depending on the type of substance and casing. However, in other embodiments, the sizes, dimensions and weight may be larger or smaller. Sizes and dimension may include without limitation, a pocket size housing 3" diameter to 4"diameter, small size housing 4" diameter to 6" diameter, medium size housing 7" diameter to an 8" diameter, and large size housing 8" diameter to 10" diameter.

In one embodiment of the present invention, the stimulator apparatus may include at least one aperture 106 for at least partially receiving the organ. A perimeter 108 may provide a semi-rigid boundary to provide structure to the at least one aperture. The organ may include, without limitation, a penis. The at least one aperture may be configured to resemble a mammalian orifice, including, without limitation, a female sexual organ, an anus, and a mouth. The at least one aperture may be disposed on the housing such that the at least one grip at least partially encircles the at least one aperture for enhanced control.

Figure 2:
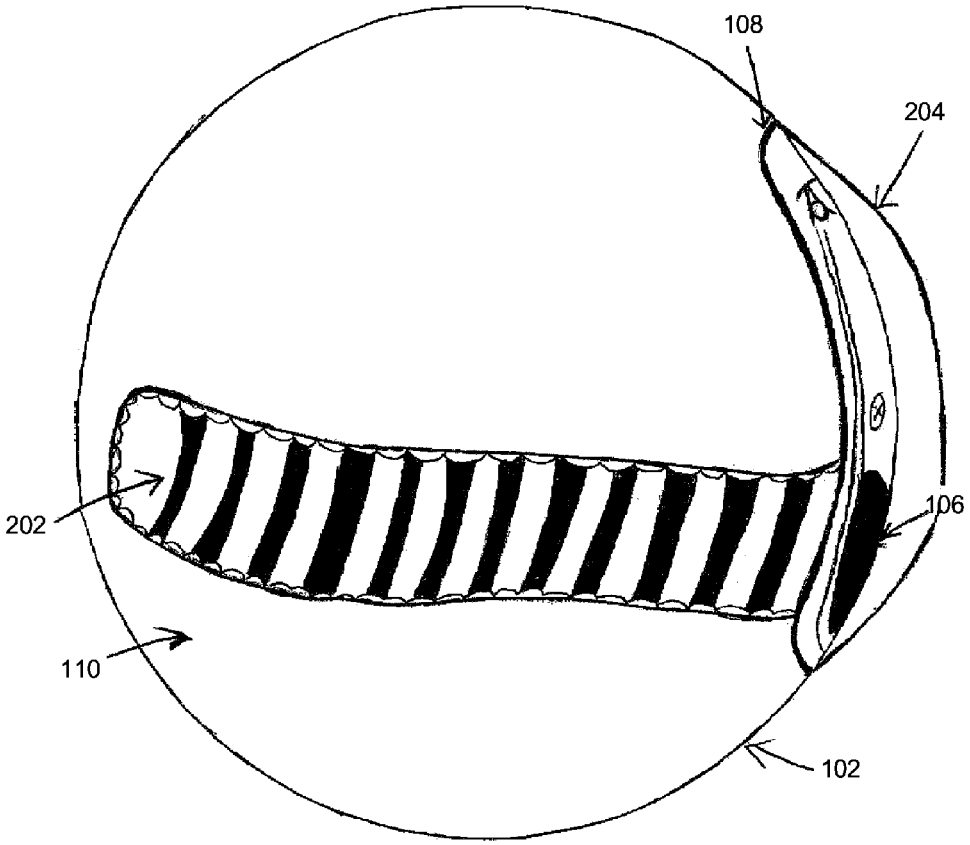
FIG. 2 illustrates a sectioned view of an exemplary stimulator apparatus with an exemplary channel, in accordance with an embodiment of the present invention.

FIG. 2 illustrates a sectioned view of an exemplary stimulator apparatus with an exemplary channel, in accordance with an embodiment of the present invention. In the present embodiment, at least one channel 202 may extend from the at least one aperture into an inner portion of the stimulator apparatus. The at least one channel may be oriented in myriad directions, and include various lengths. The at least one channel may engage the organ to provide the sexual stimulation and/or massaging effect. The at least one channel may include various textures, directions, diameters, and mechanical features to further enhance the sexual stimuli. For example, without limitation, an organ may be gripped by the at least one grip portion, and inserted into a first aperture. The organ may stiffen in response to pressure from a first channel. The sexual stimulator may be oscillated in a masturbating motion to generate friction and a massaging effect on the organ. The organ may then be removed from the first aperture and inserted into a second aperture having a different texture and diameter. A vibration motion may be utilized to provide a different sensation. In one alternative embodiment, an audio device may simulate a woman's voice to help stiffen the penis prior to entry into the at least one channel. In some embodiments, a cover 204 may restrict access to the at least one channel.

Figure 3:
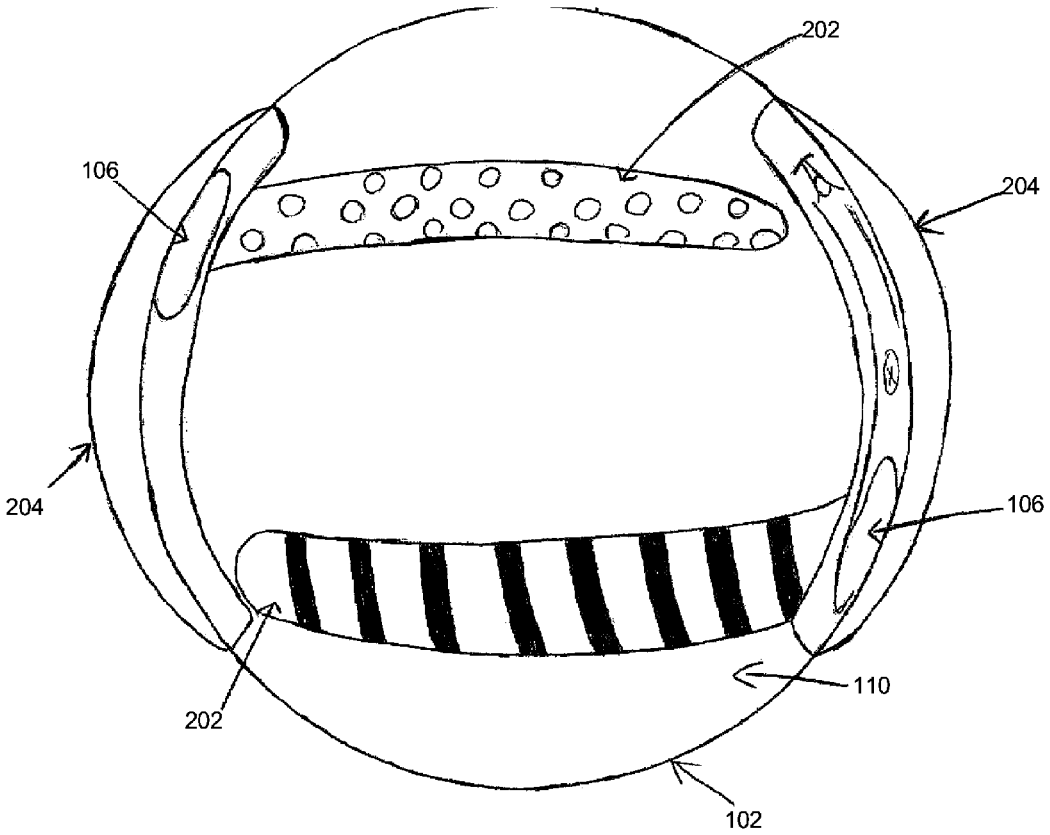
FIG. 3 illustrates a sectioned view of an exemplary stimulator apparatus with two exemplary apertures and two exemplary channels, in accordance with an embodiment of the present invention.

FIG. 3 illustrates a sectioned view of an exemplary stimulator apparatus with two exemplary apertures and two exemplary channels, in accordance with an embodiment of the present invention. In the present embodiment, various types of apertures may be utilized to receive the organ, including, without limitation, a female sexual organ, an anus, and a mouth configuration. Each aperture may include a design and a diameter different than the other. Each channel may include a size and shape that is congruent with the appropriate aperture. For example, without limitation, the anus aperture may include a channel with a smaller diameter than the channel that extends from the mouth aperture.

Figure 4A:
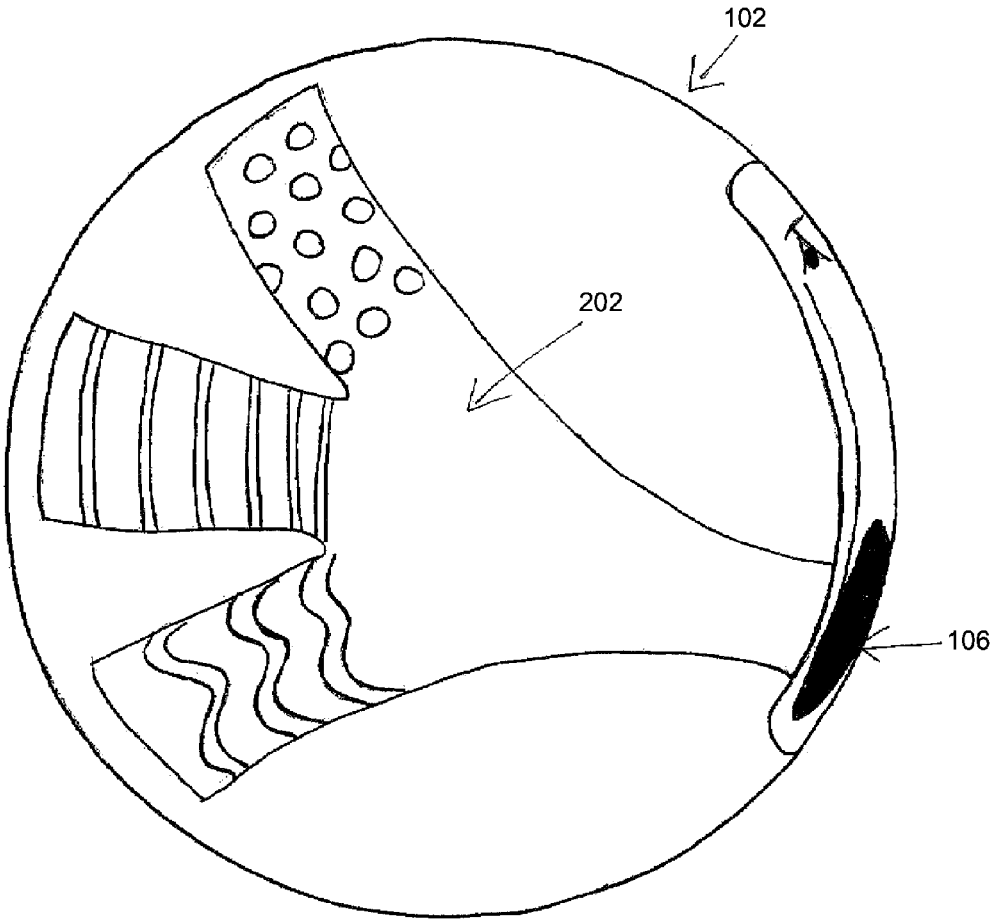
FIGS. 4A and 4B illustrate sectioned views of an exemplary stimulator apparatus with one exemplary apertures and a plurality of exemplary channels, in accordance with an embodiment of the present invention.
Figure 4B:
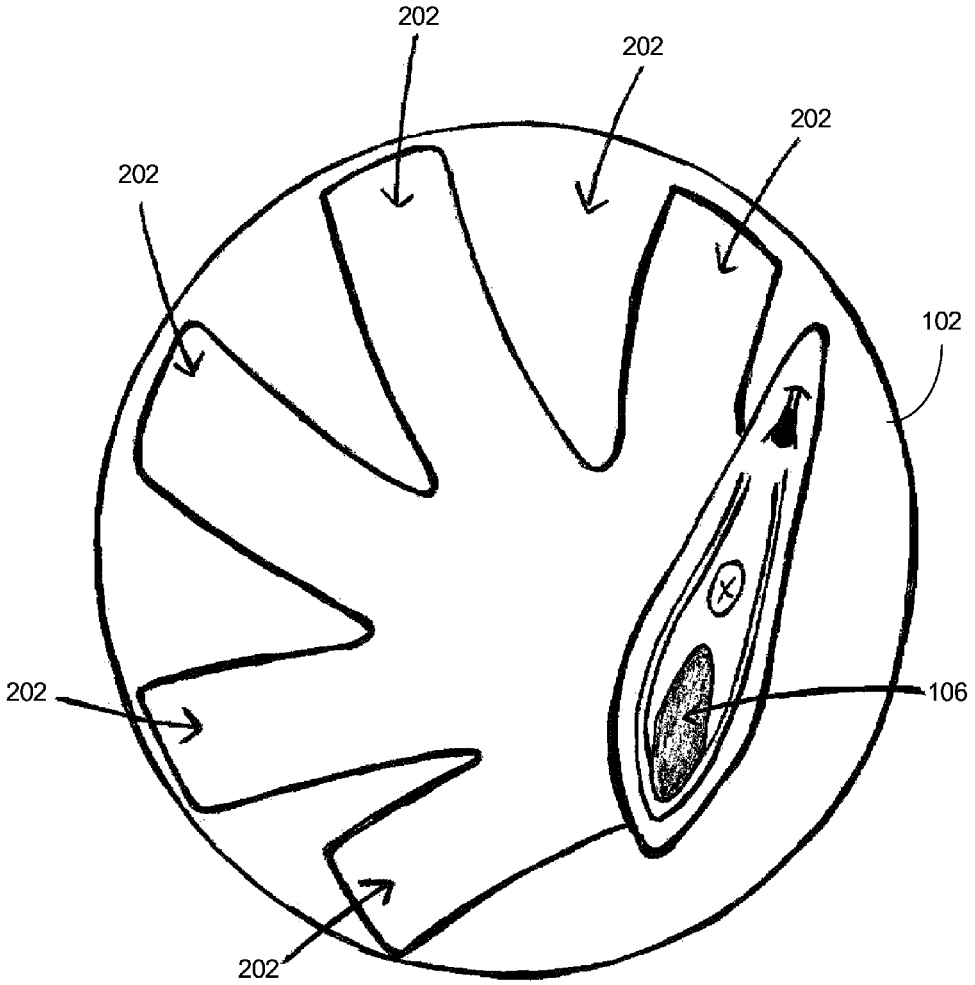

FIGS. 4A and 4B illustrate sectioned views of an exemplary stimulator apparatus with one exemplary apertures and a plurality of exemplary channels, in accordance with an embodiment of the present invention. In the present embodiment, a plurality of channels may extend from the same aperture. In this manner, the organ may experience multiple stimuli inside each channel and switch between channels without being removed from the aperture. The at least one channel may include various textures and shapes, including, without limitation, waves, ribs, dimples, and grooves. In some embodiments, the at least one channel may include mechanical devices to enhance the stimulation, including, without limitation, a vibrating motor, a pressure vacuum, a warming device, and a suction device. Each channel may have its own mechanical feature to differentiate from the others. In some embodiments, the at least one channel may include a water vessel to provide a unique stimulation.

Figure 5:
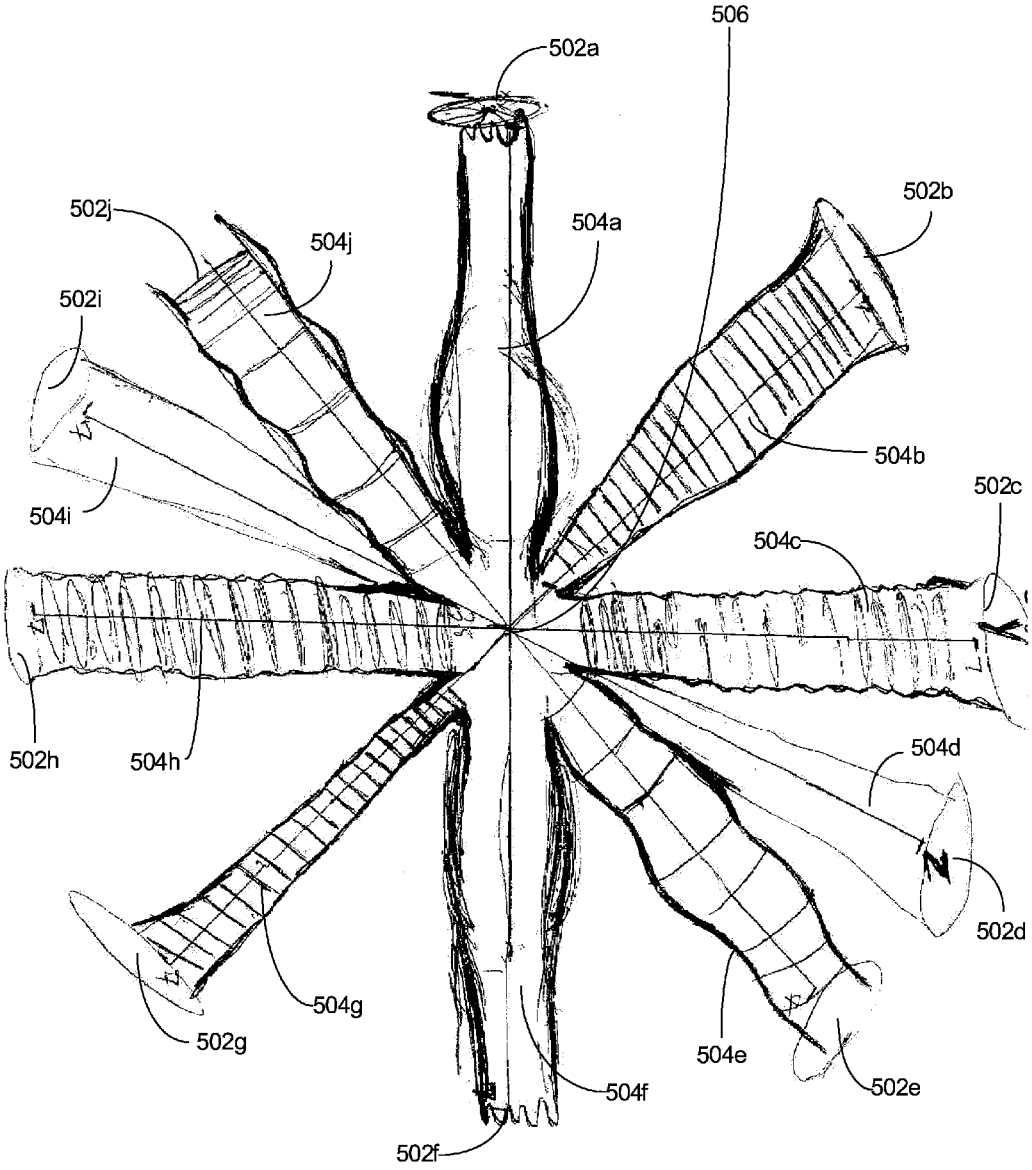
FIG. 5 illustrates a sectioned view of an alternative embodiment of an exemplary stimulator apparatus having a plurality of channels that met at a central point, in accordance with an embodiment of the present invention.

FIG. 5 illustrates a sectioned view of an alternative embodiment of an exemplary stimulator apparatus having a plurality of channels that met at a central point, in accordance with an embodiment of the present invention. In the present embodiment, the sexual stimulator may include a plurality of apertures 502*a-j* disposed to form a spherical shape. A plurality of channels 504*a-j* may extend from each aperture, meeting at a central point 506. In one embodiment, 6-10 apertures having different dimensions and textures may be utilized. In yet another alternative embodiment, the stimulation apparatus may be utilized to massage fingers on a hand. In yet another alternative embodiment, the stimulation apparatus may include a brush and water stream for cleaning residue from the at least one channel.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing a spherical sexual stimulator according to the present invention will be apparent to those skilled in the art. Various aspects of the invention have been described above by way of illustration, and the specific embodiments disclosed are not intended to limit the invention to the particular forms disclosed. The particular implementation of the spherical sexual stimulator may vary depending upon the particular context or application. By way of example, and not limitation, the spherical sexual stimulator described in the foregoing were principally directed to a spherical stimulator having various apertures and channels implementations; however, similar techniques may instead be applied to massaging fingers of a hand, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus comprising:

a housing structure, said housing structure comprises a spherical shape housing structure, said spherical shape housing structure further comprises at least a circumference, in which said spherical shape housing structure further comprising;

a casing section, said casing section comprises a spherical shape exterior casing section;

an aperture component, said aperture component being disposed at a proximate first area of a surface of said spherical shape exterior casing section, said aperture component comprises at least one aperture component, wherein said at least one aperture component being operable to at least partially receive an organ;

a perimeter section, said perimeter section being disposed at a proximate second area of said surface of said spherical shape exterior casing section, said perimeter section being configured to provide a semi-rigid boundary around said aperture component;

an interior section, said interior section being disposed on an inner portion of said spherical shape exterior casing section;

a substance element, said substance element being disposed in said interior section, wherein said substance element being configured to enhance a sexual stimuli;

a channel segment, said channel segment comprises at least one channel segment, wherein an open end portion of said at least one channel segment is configured to couple with said aperture component, said at least one channel segment being further configured to extend from said at least one aperture component into said interior section of said spherical shape housing structure, said at least one channel segment further being configured to engage said substance element; and a grip portion, said grip portion being disposed at a second top surface of said spherical shape exterior casing section and extending into said interior section, said grip portion is configured to at least partially encircle said at least one aperture, wherein said grip portion being operable for a finger to enhance stimulation and manipulation of said apparatus.

2. The apparatus of claim 1, in which said spherical shape housing structure comprises at least a ball shape housing structure, said grip portion being configured to be operable to be gripped by at least one finger.

3. The apparatus of claim 1, wherein said spherical shape housing structure comprises at least a ball shape housing structure, said ball shape housing structure is configured to be operable to be held by a hand for manipulating the apparatus in at least a 180 degree range.

4. The apparatus of claim 1, in which said substance element comprises at least one of an elastomer gel and medical grade silicone.

5. The apparatus of claim 1, in which said spherical shape exterior casing section comprises a semi-rigid spherical shape exterior casing section being configured to help protect components or segments of said apparatus.

6. The apparatus of claim 1, in which said spherical shape housing structure further comprises silicone.

7. The apparatus of claim 1, in which said spherical shape housing structure comprises a diameter of approximately 7 inches and a circular circumference of approximately 21.99 inches.

8. The apparatus of claim 1, in which said at last one aperture component comprises at least a first aperture component and a second aperture component, the second aperture component having a different texture and diameter from said first aperture component, where said first aperture component and second aperture component are configured to provide a first and second organ diameter.

9. The apparatus of claim 1, in which said at least one aperture component comprises a female sexual organ shape and texture.

10. The apparatus of claim 1, in which said at least one aperture component comprises a cover piece, said cover piece being configured to regulate access to said at least one channel segment.

11. The apparatus of claim 1, in which said at least one channel segment comprises a female sexual organ shape and texture.

12. The apparatus of claim 1, in wherein said at least one channel segment comprises at least two or three channel segments, said at least two or three channel segments comprises at least two or three different diameters being configured to accommodate organs having different diameters.

13. The apparatus of claim 1, in which said at least one channel segment comprises at least two or three channel segments, said at least two or three channel segments comprises at least two or three different diameters to accommodate organs having diameters, said at least two or three channel segments further comprises different orientations.

14. The apparatus of claim 1, in which said at least one channel segment comprises a water vessel, said water vessel being configured to provide stimulation to said organ.

15. The apparatus of claim 1, in which said at least one channel segment comprises at least one of a plurality of waves, a plurality of dimples, and a plurality of ridges.

16. The apparatus of claim 1, in which said at least one channel segment comprises a warming device, said warming device being configured to provide stimulation to said organ.

17. The apparatus of claim 1, in which said channel segment comprises at least two or three channel segments, said at least two or three channel segments comprises at least two or three different diameters to accommodate a changing diameter of said organ, where at least one channel segment comprises a vibrating device, said vibrating device being configured to provide stimulation to said organ.

18. The apparatus of claim 1, in which said at least one channel segment comprises a pressure chamber, said pressure chamber being configured to provide stimulation to said organ.

19. An apparatus comprising:

means for housing a stimuli, said stimuli housing means comprises a spherical shape housing means;

means for gripping said housing means with at least one finger;

means for accepting an organ on a surface of said spherical shape housing means, said organ accepting means comprises at least two organ accepting means, said at least two organ accepting means being configured to accept at least an expansion of said organ during a stimulation;

means for denying access to said organ accepting means;

means for extending said organ accepting means to an interior section of said spherical shape housing means; and means for enhancing said stimuli, said stimuli enhancing means being disposed in said interior section of said spherical shape housing means.

20. An apparatus consisting essentially of:

a housing structure, said housing structure comprising a spherical shape housing structure, said housing further comprising at least one grip portion, said at least one grip portion being configured to be operable to grip by at least one finger for manipulating said housing structure, said housing structure further comprising a substance, said housing structure further comprising silicone, said housing structure further comprising a casing, said casing further being configured to help protect internal components of said apparatus;

at least one aperture component, wherein said at least one aperture component being configured to at least partially receive an organ, said at least one aperture component comprising a cover for regulating access to said housing structure, said at least one aperture component further comprising a perimeter, said perimeter comprising a semi-rigid boundary for providing structure to said at least one aperture component, said at least one aperture component further comprising a female sexual organ shape and texture; and at least one channel section, wherein said at least one channel section being configured to extend from said at least one aperture component into an inner portion of said housing structure, said at least one channel section further being configured to engage said organ, said at least one channel section comprises at least two or three channel sections, said at least two or three channel sections comprising different diameters being operable to accommodate an expansion of said organ, said at least one channel section further comprising different textures, said at least one channel section further comprising a water vessel being configured to provide a first stimulation, said at least one channel section further comprising a pressure chamber being configured to provide a second stimulation.

* * * * *